US006260824B1

(12) United States Patent
Aderhold

(10) Patent No.: US 6,260,824 B1
(45) Date of Patent: Jul. 17, 2001

(54) BOARD SAVER PRY BAR

(76) Inventor: John B. Aderhold, 3765 Piney Point Rd., Conroe, TX (US) 77301

( * ) Notice: Subject to any disclaimer, the term of this patent is extended or adjusted under 35 U.S.C. 154(b) by 0 days.

(21) Appl. No.: 09/587,859

(22) Filed: Jun. 6, 2000

(51) Int. Cl.[7] ..... B66F 3/00

(52) U.S. Cl. ..... 254/17; 254/21; 254/113; 254/120; 254/131; 254/44

(58) Field of Search ..... 254/25, 17, 11, 254/44, 21, 133 A, 8 R, 131.5, 113, 134, 120, 131; 269/6

(56) References Cited

U.S. PATENT DOCUMENTS 178,407 * 6/1876 Butts ..... 254/25
977,986 * 12/1910 Waddell ..... 254/25
1,309,734 * 7/1919 Hemfling, Sr. ..... 254/25
2,457,231 * 12/1948 Henderson ..... 254/25
2,525,226 * 10/1950 Lawellin ..... 254/25
2,906,498 * 9/1959 Erwin ..... 254/25

* cited by examiner

*Primary Examiner*—Joseph J. Hail, III
*Assistant Examiner*—Lee Wilson
(74) *Attorney, Agent, or Firm*—Bracewell & Patterson, L.L.P.

(57) ABSTRACT

A pry bar capable of removing boards while minimizing damage during removal so that the boards may be reused. The pry bar having a handle, a cross bar, and two pairs of pry arms with each pair having a different length. The handle forms an acute angle with one pair of pry arms and an obtuse angle with the other pair of pry arms. Either pair of pry arms is placed behind the board to be removed then force is exerted against the handle to remove the board.

2 Claims, 1 Drawing Sheet

BOARD SAVER PRY BAR

BACKGROUND OF INVENTION

1. Field of Invention

The present invention relates to a pry bar for removing boards from floors, siding, walls, and other areas where boards are attached to a structure. The pry bar provides an effective and more convenient tool for removing boards while minimizing damage to the boards so that they may be reused.

2. Description of the Prior Art

Pry bars are widely used to remove or dislodge objects. Pry bars typically are operated by hand and consist of a long handle, a fulcrum, and a pry arm shorter in length than the handle. The user of a pry bar applies force to the handle which in turn is translated across the fulcrum to the pry arm. The resulting force at the pry arm is greater than the force applied by the user because the pry arm is of a shorter length than the handle. Thus, a pry bar operates by magnifying the force applied by a user and, as a result, enables the user to remove or dislodge objects that cannot be removed or dislodged by hand.

Pry bars have been modified over the years to increase ease of use, to perform additional functions, and to suit specific purposes. For instance, U.S. Pat. No. Des. 236,872 (Froehlich) describes a pry bar specifically designed to remove boards. The Froehlich pry bar is comprised of a handle, a crossbar which acts as the fulcrum, and a pair of short, spaced pry arms which form an acute angle with the handle. To operate the pry bar, the pry arms are placed behind the board to be removed, and the crossbar is placed against the stud holding the board. A force is applied to the handle which in turn is magnified at the short pry arms, thus generating enough force to remove the board. While such a design is adequate to remove boards under most circumstances, the design is limited because the acute angle between the handle and pry arms precludes a user from exerting body weight to assist in the removal of horizontal boards. For example, if the Froehlich pry bar is used to remove a board from a floor, the user cannot exert body weight against the handle because of the acute angle between the handle and pry arms. In this circumstance, an obtuse angle between the handle and pry arms would allow the user to exert body weight against the handle, thus decreasing the effort the user must generate to remove the board.

Also, the Froehlich design only provides a single pair of pry arms of a given length, which limits the amount of force that the user can generate at the pry arms. More specifically, a user generates a given amount of torque when the user applies force to the pry bar handle. Because torque is equal to force times distance, the force generated at the end of the pry arms is equal to the torque divided by the length of the pry arms measured from the crossbar. As a result, for a given force applied by a user, the force generated at the tip of the pry arms increases if the length of the pry arms is decreased. In other words, decreasing the length of the pry arms increases the leverage that a user can generate with the pry bar, but the pry arm length must be sufficient to remove the board without damage. In this respect, a pry bar with multiple length pry arms would provide more versatility.

Finally, the Froehlich design does not include a feature which can remove nails, which is the primary mechanism for attaching boards.

U.S. Pat. No. 1,309,734 (Hemfling) also describes a pry bar specifically designed to remove boards. Similar to Froehlich, the Hemfling pry bar is comprised of a handle, a crossbar, and a pair of short, spaced pry arms. Unlike Froehlich, the Hemfling pry bar has a claw for removing nails, and the angle between the handle and pry arms is obtuse. Thus, Hemfling improves upon Froehlich in that the Hemfling pry bar can remove nails and allows a user to exert body weight when removing horizontal boards. However, similar to Froehlich, Hemfling is limited because it provides only a single pair of pry arms of a given length. In addition, the Hemfling design cannot be used to remove boards under certain circumstances because of the obtuse angle between the handle and pry arms. For example, if a floor board located near a wall must be removed and the only access to the bottom surface of the board is between the board and wall, the Hemfling pry bar cannot be used because the wall will prevent the handle from traveling through a sufficient range of motion to dislodge or remove the board. A similar problem occurs if a horizontal wall board located near the floor must be removed and the only access to the back surface of board is between the board and floor. A pry bar with an acute angle between the handle and pry arms would address this design limitation of Hemfling.

Finally, U.S. Pat. No. 2,680,003 (Feinstein) describes a pry bar specifically designed to remove boards. The Feinstein pry bar also is comprised of a handle, a cross bar, and a pair of short, spaced pry arms. While the Feinstein pry bar provides the same advantages over Froehlich that Hemfling provides, Feinstein also suffers from the same design limitations as Hemfling as a result of the single pair of pry arms and the obtuse angle between the handle and pry arms.

SUMMARY OF INVENTION

Briefly, the present invention provides a pry bar for removing or dislodging boards while preventing or minimizing the damage to the boards during removal. The pry bar is comprised of a handle, a crossbar, and two pairs of pry arms with each pair having a different length. The handle forms an acute angle with the shorter pry arms and an obtuse angle with the longer pry arms. The ends of the shorter pry arms and one end of the handle further include notches for removing nails and other fasteners.

The pry bar is operated by placing either the shorter pry arms or the longer pry arms behind the board to be removed then exerting force against the handle. The longer pry arms allow the user to apply body weight when removing boards horizontal to the ground and, compared to the shorter pry arms, minimize damage when removing boards having a width greater than the length of the shorter pry arms. The shorter pry arms are more appropriate when the width of the board to be removed is equal to or less than the length of the shorter pry arms. In addition, for a given force exerted on the handle, the shorter pry arms will generate a greater force than the longer pry arms. As a result, the shorter pry arms also are more appropriate when a board is difficult to remove.

DESCRIPTION OF THE PREFERRED EMBODIMENT

Figure 1:
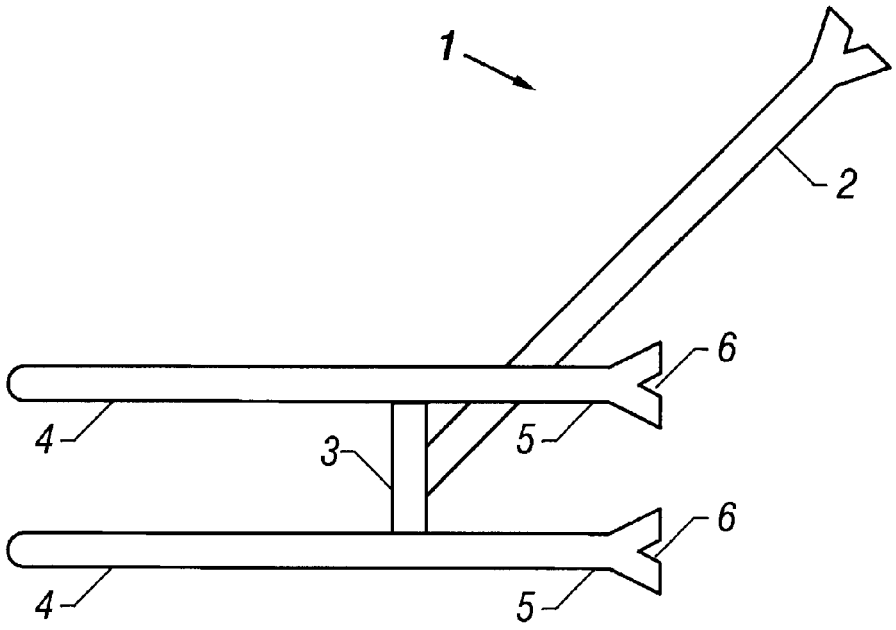
FIG. 1 is an isometric view of the pry bar.
Figure 2:
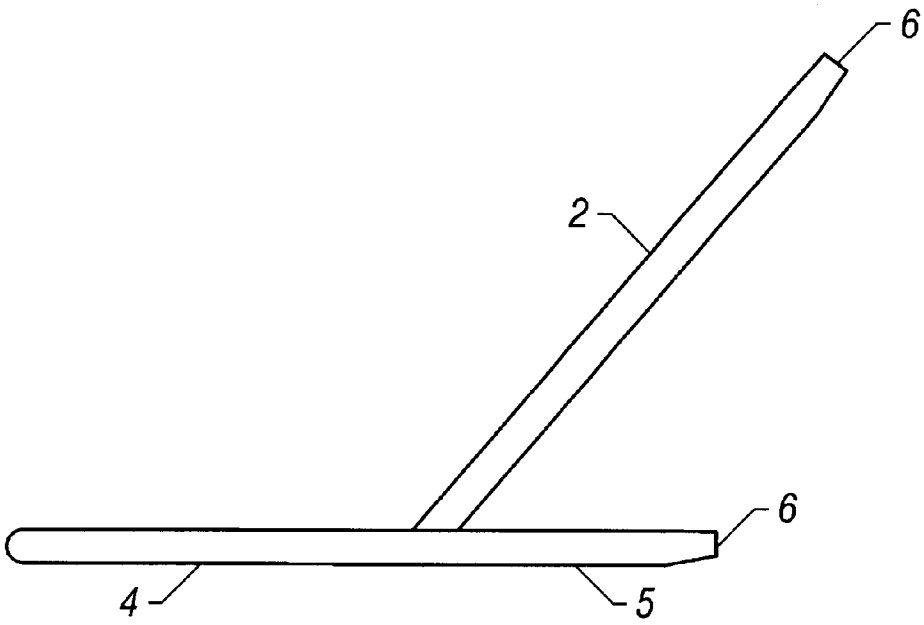
FIG. 2 is a side view of the pry bar.

FIGS. 1 and 2 show a pry bar 1 according to the present invention. The pry bar 1 has a handle 2 attached to the fulcrum or crossbar 3. Preferably, the handle 2 is attached at or near the mid-point of the crossbar 3. A first pair of pry arms 4 is attached to the crossbar 3, and a second pair of pry arms 5 is attached to the cross bar 3. In a preferred embodiment, the first pair of pry arms 4 and the second pair of pry arms 5 are substantially parallel, and the first pair of pry arms 4 is greater in length than the second pair of pry arms 5. It should be understood that the first pair of pry arms 4 and the second pair of pry arms 5 are not required to be substantially parallel, and the second pair of pry arms 5 can be made greater in length than the first pair of pry arms 4.

The handle 2 preferably may form an obtuse angle with the first pair of pry arms 4 and an acute angle with the second pair of pry arms 5. However, it should be understood that the handle may instead form an acute angle with the first pair of pry arms 4 and an obtuse angle with the second pair of pry arms 5.

Preferably, the handle 2 and the second pair of pry arms 5 may further include a forked or notched end 6 for removing staples, screws, nails, or other fasteners. It should be understood that the first pair of pry arms 4 can include notches 6 and that the notches can be removed from the second pair of pry arms 5 and the handle 2.

The pry bar 1 may be manufactured from any suitable material. Preferably, the pry bar 1 is formed of a suitable metal. More preferably, the pry bar is formed from steel. The individual elements or components of the pry bar 1 may be attached or assembled using any suitable method known in the art. Preferably, the components are assembled by welding. However, it should be understood that any suitable means for attaching metals or similar materials may be used to assemble the pieces of the pry bar 1.

In use, the pry bar 1 of the present invention is capable of removing boards, panels and the like from an existing structure. One pair of arms 4, 5 of the pry bar 1 may be moved or positioned under the board to be removed. Preferably, the arms 4,5 will extend across the entire width of the board, thereby providing greater support during the removal process and preventing damage to the board. A force may be exerted on the handle 2 in the appropriate direction, which causes the arms positioned under the board to move in an opposite direction, thereby lifting the board from the structure. Depending on the location of the board and the nature of the structure, either pair of arms may be used to dislodge the board or panel. Where the board is to be removed from a wall or similar structure having studs to which the board is attached, the crosspiece 3 of the pry bar 1 may be placed or positioned to rest on a stud, thus providing a pivot point on which the handle 2 may act. Since the board will typically be fastened to the stud in such a structure, the arms will be relatively near the point of attachment. This further aids the device in preventing splitting, cracking or other damage to the board during the removal process.

The claws, notches or forks provided on the ends of certain arms and/or the handle may be used to remove fasteners, such as nails, staples, screws and the like. The fastener to be removed is positioned within the tapered space of the notch and the lever action of the pry bar (created by providing a force on the handle) may dislodge the fastener. Due to the relatively long length of the handle, removal of such fasteners is greatly facilitated.

The foregoing disclosure and description of the invention are illustrative and explanatory thereof, and various changes in size, shape and materials, and components, as well as in the details of the illustrated construction may be made without departing from the spirit of the invention.

What is claimed is:

1. A pry bar for removing boards comprising:

a) a handle having a first end and a second end;

b) a crossbar attached to the first end of the handle;

c) a first pair of pry arms, each having a first end and a second end, wherein the first ends are attached to the crossbar and the second ends include a notch; and d) a second pair of pry arms, each having a first end and a second end, wherein the first ends are attached to the crossbar.

2. A pry bar for removing boards comprising:

a) a handle having a first end and a second end;

b) a crossbar attached to the first end of the handle;

c) a first pair of pry arms, each having a first end and a second end, wherein the first ends are attached to the crossbar and the second ends include a notch; and d) a second pair of pry arms, each having a first end and a second end, wherein the first ends are attached to the crossbar and the second ends include a notch.

* * * * *